US006272966B1

(12) United States Patent
Montle

(10) Patent No.: US 6,272,966 B1
(45) **Date of Patent: *Aug. 14, 2001**

(54) UPHOLSTERY WELT CORD

(75) Inventor: Robert E. Montle, Statesville, NC (US)

(73) Assignee: Sackner Products, Inc., Grand Rapids, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/984,057

(22) Filed: Dec. 3, 1997

Related U.S. Application Data

(60) Provisional application No. 60/047,988, filed on May 28, 1997.

(51) Int. Cl.[7] ..... D04C 1/00
(52) U.S. Cl. ..... 87/6; 87/7; 428/373
(58) Field of Search ..... 87/1, 2, 5–9, 13; 57/904, 210, 235; 428/373, 377

(56) References Cited

U.S. PATENT DOCUMENTS

| | | | | |
|---|---|---|---|---|
| 2,107,467 | * | 2/1938 | Buhler | 96/26 |
| 2,248,123 | * | 7/1941 | Sackner | 57/162 |
| 2,722,661 | * | 11/1955 | Francis | 87/1 |
| 2,741,149 | * | 4/1956 | Francis | 87/1 |
| 2,816,415 | * | 12/1957 | Lappala | 57/145 |
| 3,129,631 | * | 4/1964 | Hill et al. | 87/6 |
| 3,482,483 | * | 12/1969 | Ambrose | 87/6 |
| 3,578,764 | * | 5/1971 | Nunnally | 87/6 |
| 3,876,495 | * | 4/1975 | Esler | 161/178 |
| 4,024,895 | * | 5/1977 | Barron | 57/139 |
| 4,093,773 | * | 6/1978 | Danko | 428/365 |
| 4,265,972 | * | 5/1981 | Rudner | 428/392 |
| 4,534,262 | * | 8/1985 | Swenson | 87/6 |
| 4,545,283 | | 10/1985 | Sandberg et al. . | |
| 4,547,426 | | 10/1985 | Montle . | |
| 4,598,622 | | 7/1986 | Briggs . | |
| 5,124,200 | * | 6/1992 | Malonee | 428/296 |
| 5,701,730 | * | 12/1997 | Kennedy et al. | 57/224 |

* cited by examiner

*Primary Examiner*—John J. Calvert
*Assistant Examiner*—Tejash Patel
(74) *Attorney, Agent, or Firm*—Price Heneveld Cooper DeWitt & Litton

(57) ABSTRACT

A welt cord is provided which includes a core made of a polymeric, flexible material and enclosed by a cellulose cover. The cellulose cover is held in place around the polymeric core by a jacket of threads. The ratio of the volume of cover material to the volume of core material is less than about 3.5.

29 Claims, 4 Drawing Sheets

UPHOLSTERY WELT CORD

RELATED APPLICATION

This application claims the benefit of U.S. Provisional Application No. 60/047,988, filed May 28, 1997, and entitled UPHOLSTERY WELT CORD, the entire disclosure of which is hereby incorporated by reference.

BACKGROUND OF THE INVENTION

The present invention relates to fire retardant welts or the beading cords used in upholstery.

The furniture industry has been under self-imposed pressure to improve the fire resistance of upholstered furniture and, therefore, examined carefully the fire retardant characteristics of each component of upholstered furniture, including the welt cords. Foremost in this examination is the resistance to ignition by burning cigarettes or cigars which cause most upholstery fires.

There are two basic kinds of welt cords. One type is an extruded foam or solid plastic bead. The fire retardation characteristics of the plastic bead were increased by enclosing a wire within and along the length of the bead to help conduct heat away from a burning cigarette placed on the bead so that the plastic material near the burning cigarette will tend not to be heated to its ignition temperature. However, the plastic welt cord, even when foamed, is fairly hard to the touch and, therefore, undesirable. In many cases the welt is supposed to be fairly innocuous to the touch. A second kind of welt cord is made of cellulose filler material with a braided jacket. As discussed below, the cellulose welt cord has previously been made more fire resistant by incorporating a strip of foil or other heat conductive member into the cord along its longitudinal length.

In one prior construction as disclosed in U.S. Pat. No. 4,598,622 dated Jul. 8, 1986 entitled COMBUSTION INHIBITING CONSTRUCTION OF A WELT CORD, the cellulose welt cord has been made more fire retardant by incorporating a strip of foil into the cord along its longitudinal length to conduct heat away from a point source of heat such as a cigarette so that the cellulose near the source will not reach ignition temperature. The foil strip, however, is not resilient and has a memory. As a result, it crimps when the cord is bent, distorting the cross-sectional shape of the bent cord at the bend. Thus, when the welt cord is bent around a cushion or couch corner, for example, the welt cord will bulge at the bend, making the welt look irregular and sloppily installed.

In another prior construction as disclosed in U.S. Pat. No. 4,545,283 dated Oct. 8, 1985 entitled UPHOLSTERY WELT CORD, a small diameter foamed plastic bead was incorporated into the center of a cellulose-type welt cord with an aluminum foil layer located between the cellulose and the foam bead. When such a cord is bent, the foam assists in holding the shape of the welt cord because the "memory" of the plastic core tends to restore the cord to substantially its original cross-sectional shape after bending. However, this design is not completely satisfactory in retaining the shape of the welt cord. Further, it does not eliminate another problem with the use of foils, i.e., the foil tends to break as it is being drawn into the welt cord during manufacturing. Breakage can be greatly minimized by drawing the foil slowly into the cord, but this increases production time and costs. In addition, it complicates the braiding apparatus and method by running a larger number of elements through the braider.

Still another cord construction is disclosed in U.S. Pat. No. 4,547,426 dated Oct. 15, 1985 entitled UPHOLSTERY WELT CORD, which includes a cellulose outer cover that receives and encloses a core made of a polymeric material which has a heat conductive filament extending the length of the welt cord within the core. The cellulose cover is held on the core by a jacket of threads which are braided or wound around the cord. When a smoldering object such as a cigarette is placed against the welt cord, the cigarette will slowly burn through the threads and cellulose body in the region of the smoldering cigarette and will melt a small section of core. When the heat of the cigarette reaches the heat conductive filament, the heat of the cigarette is dissipated along the filament such that the materials in the region of the heat source will not reach a temperature where they will ignite. However, this design is not completely satisfactory due to the cost of the heat conductive filament. Further, this welt cord is deemed undesirable by many users due to people receiving injuries from the filament at cord splices, as well as other protrusions. In the process of using this welt cord, when it is inadvertently stretched and then relaxed, the polymeric cord returns to its original length, but the heat conductive filament may protrude to the outside of the welt cord.

Accordingly, it is desired in the welt cord and furniture industries to have a welt cord that is easy and inexpensive to manufacture, while being flame-retardant and flexible, but able to retain the original shape of the welt cord.

SUMMARY OF THE INVENTION

The present invention comprises a welt cord having a polymeric core covered by a cellulose outer cover, where the ratio of the volume of the cover material to the volume of the core material is less than about 3.5.

DETAILED DESCRIPTION OF THE PREFERRED EMBODIMENT

Figure 1:
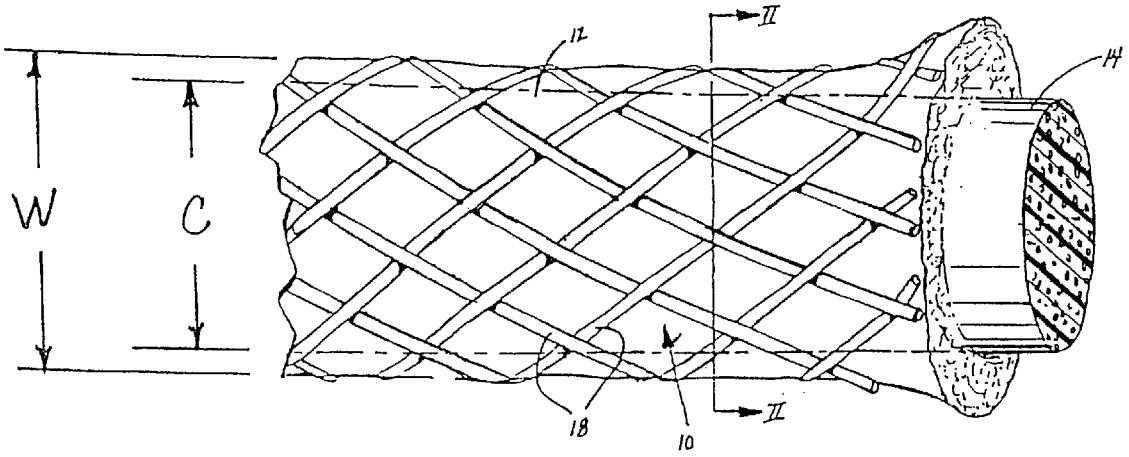
FIG. 1 is a side elevational view of a section of the welt cord made in accordance with this invention.

The welt cord 10 (FIGS. 1 and 2) of the present invention includes a cellulose outer cover 12 which receives and encloses a core 14 made of a polymeric material. Cellulose cover 12 is held on the core by a jacket of threads 18 which are braided or wound around welt cord 10. When a smoldering object, such as a cigarette, is placed against welt cord 10, the cigarette will slowly burn through the furniture or cushion fabric, then burn through threads 18 and cellulose body 12 in the region of the smoldering cigarette and will begin to melt core 14. However, when the ratio between the cover material volume and the core volume is small enough, the heat of the cigarette is dissipated along core 14 such that the materials in the region of the heat source will not reach a temperature where they will ignite. In this case, the ratio is defined as the ratio of (volume of cover material 12)/(volume of core material 14) or:

$$R=(W^2-C^2)/C^2.$$

Where

R=Ratio;

W=Welt Cord 10 outer diameter; and

C=Polymeric Core 14 outer diameter

As shown below, when the value of R is less than about 3.5 there is enough core 14 mass to dissipate enough heat away from the heat source such that the materials in the region will not reach a temperature where they will ignite. Such a ratio allows welt cord 10 to be free of a heat conductive member.

Cellulose body 12 is made of a wadded cellulose tissue material similar to facial tissue. The material includes layered sheets of thin, crepe cellulose tissue wadded and wrapped in a cylindrical fashion around core 14 and retained in the cylindrical shape by jacket threads 18 braided or wound around cellulose body 12.

Core 14 is made of a polymeric material. Preferably, a foamed polymeric material such as polyethylene is used, which is formed by mixing pellets of polymeric material with a suitable blowing agent. The mixture of polymeric material and blowing agent is heated to a temperature sufficient to decompose the blowing agent completely. Thereafter, the mixture is extruded in a well-known way through a die having circular cross section to produce core 14 with a circular cross section and having a density of approximately 0.3 grams per cubic centimeter and a percent of voids of approximately 56 percent. The method or methods are described in greater detail in U.S. Pat. No. 3,876,495, the disclosure of which is incorporated herein by reference. Low density, medium density, and high density solid polyethylene, as well as other polymers such as polypropylene and nylon, may also be used to form core 14.

Jacket threads 18 are, in the preferred embodiment, glass fibers which have a long life and do not dry out and become brittle if the upholstery is washed. Threads 18 could also be made of almost any textile fibers or plastics such as cotton, nylon, polyester, polypropylene, or polyethylene.

Figure 2:
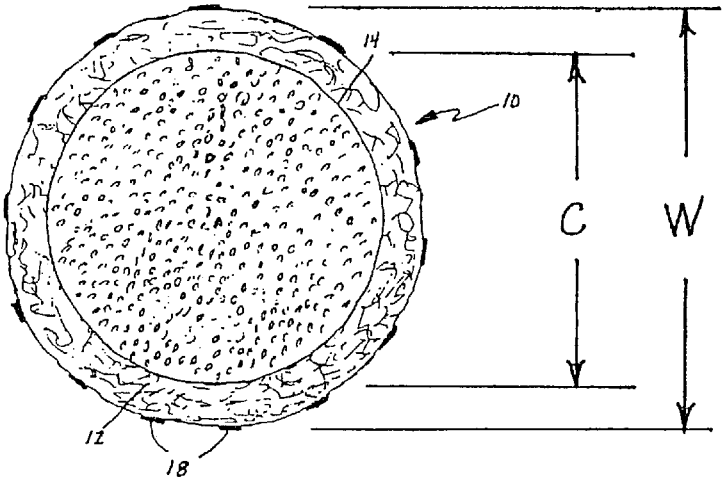
FIG. 2 is a cross-sectional view taken along the plane of line II—II of FIG. 1.

The welt cords of this invention should preferably have a ratio of less than about 3.5, more preferably less than about 3.0, and most preferably less than about 2.5. While the relative dimensions of body 12, core 14 and threaded jacket 18 are substantially as shown in FIGS. 1 and 2, typical constructions would have a built-in safety margin of a ratio of less than or equal to 2.5. Examples of such typical constructions would be as follows:

| Welt Cord 10 Diameter W | Core 14 Diameter C | R Factor |
|---|---|---|
| .250" | .135" | 2.43 |
| .189" | .101" | 2.50 |
| .156" | .084" | 2.45 |
| .125" | .067" | 2.48 |

Figure 3:
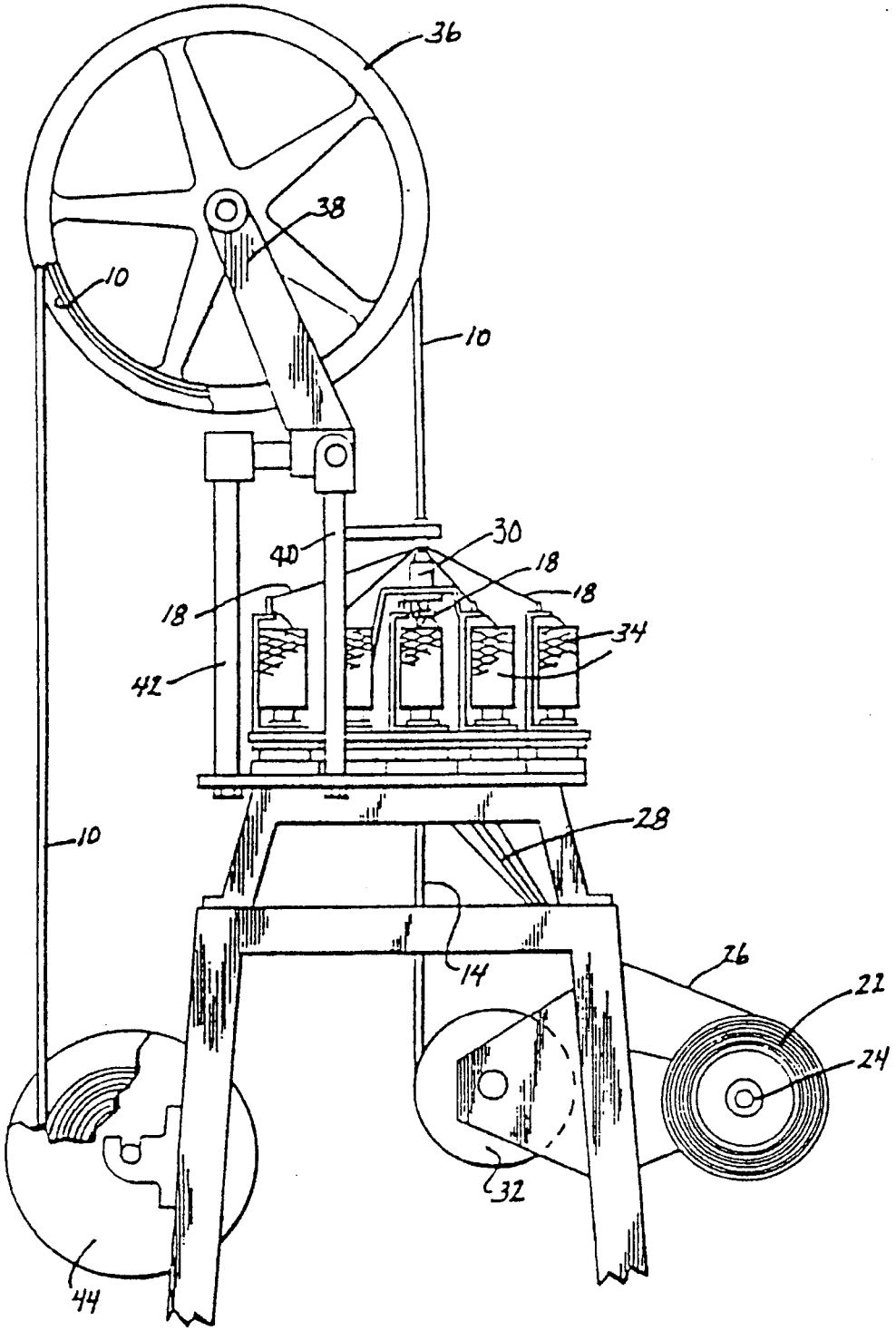
FIG. 3 is an elevational view of an apparatus for construction of the cord of FIGS. 1 and 2.

A machine for manufacturing welt cord 10 of the present invention is illustrated in FIG. 3. Such a machine is similar to the one described in U.S. Pat. No. 2,741,149, the disclosure of which is incorporated herein by reference. The winding or braiding machine (FIG. 3) includes a cellulose roll 22 mounted on a spindle 24 for rotatably supporting roll 22. A strip of cellulose material 26 is unwound from roll 22 and is crumpled and creped, as illustrated at 28 and drawn upwardly to a compressing eye 30.

A core roll 32 carries the wound polymeric core 14 and is pulled through compressing eye 30 along with the crumpled cellulose strip 26 to form body 12. As core 14 and cellulose strip 26 are being pulled through eye 30, threads 18 are unwound from spools or bobbins 34 which are driven in a conventional manner to braid threads 18 on cellulose body 12 to form a threaded jacket in a conventional manner. Cellulose strip 26, core 14, and threads 18 are pulled through eye 30 by a capstan 36 around which the completed, braided cord 10 is wound at least one complete wrap. Capstan 36 is supported by bracket 38 carried by posts 40 and 42. The completed cord is then wound on a spool 44 to be rewound for shipment and sale.

Further description of the winding or braiding machine (FIG. 3) is unnecessary because machines of this type are known in the art, are conventional, and are described in detail in U.S. Pat. No. 2,741,149.

The cord construction of the present invention does not deform greatly when bent around a corner. Core 14 has a memory such that it can be bent around a corner, yet retain substantially the same cross-sectional shape it had prior to bending. Thus, the inner cord materials will not force the cellulose body to bulge excessively when core 14 is bent, so that a smooth continuous cord shape is maintained. Further, little or no sacrifice is made in the softness or feel of cord 10 since it includes a cellulose body 12 enclosing the polymeric core 14. In addition, this design simplifies the manufacturing process, using fewer elements, causing less breakage and therefore providing increased production and reduced costs. Finally, the construction of the cord of the present invention eliminates the problems with filament protrusions causing injuries to employees and customers.

Figure 4:
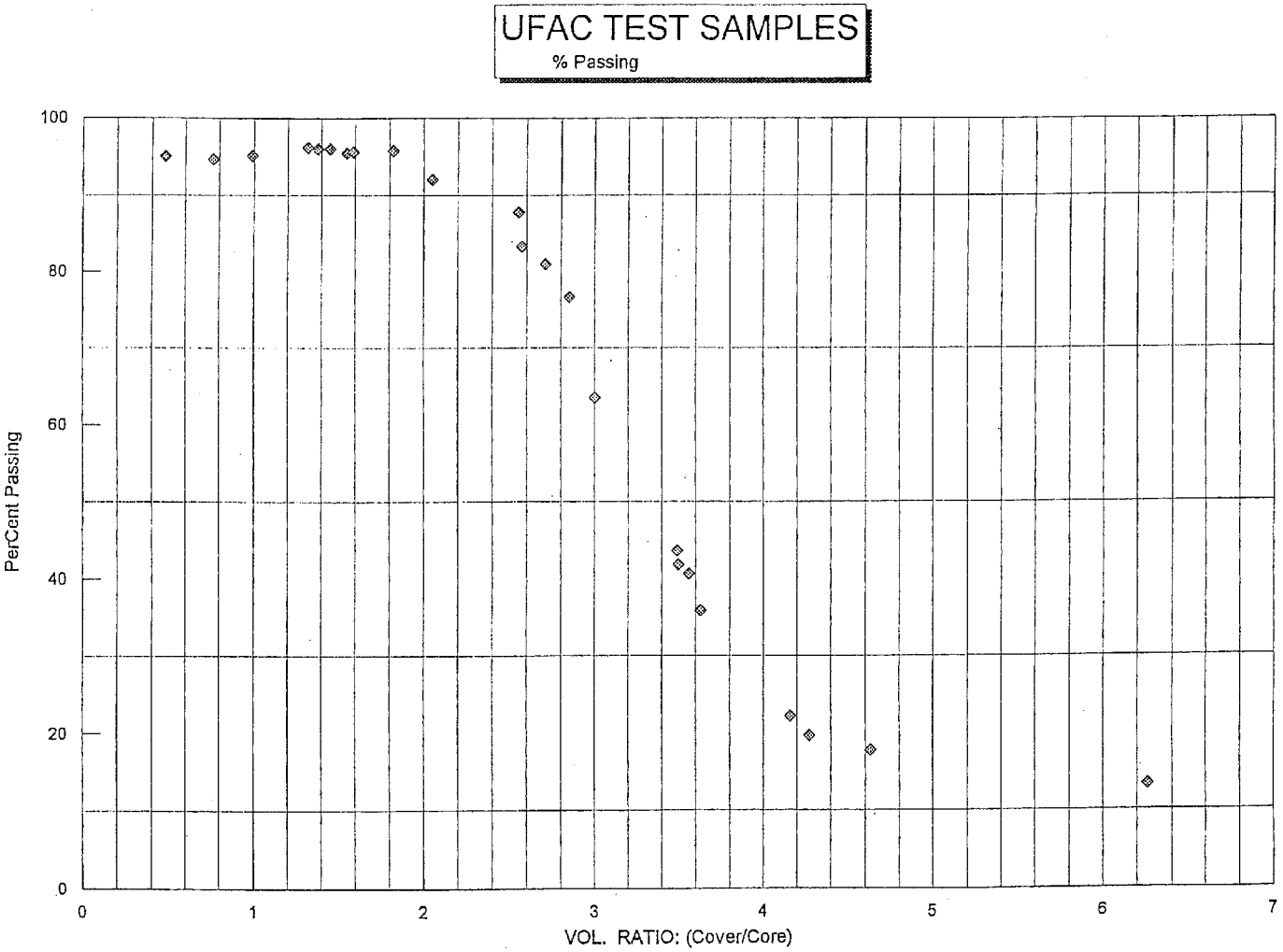
FIG. 4 is a point graph in which the cover to core volume ratio is indicated on the abscissa and the percent of samples passing the UFAC test are indicated on the ordinate.
Figure 5:
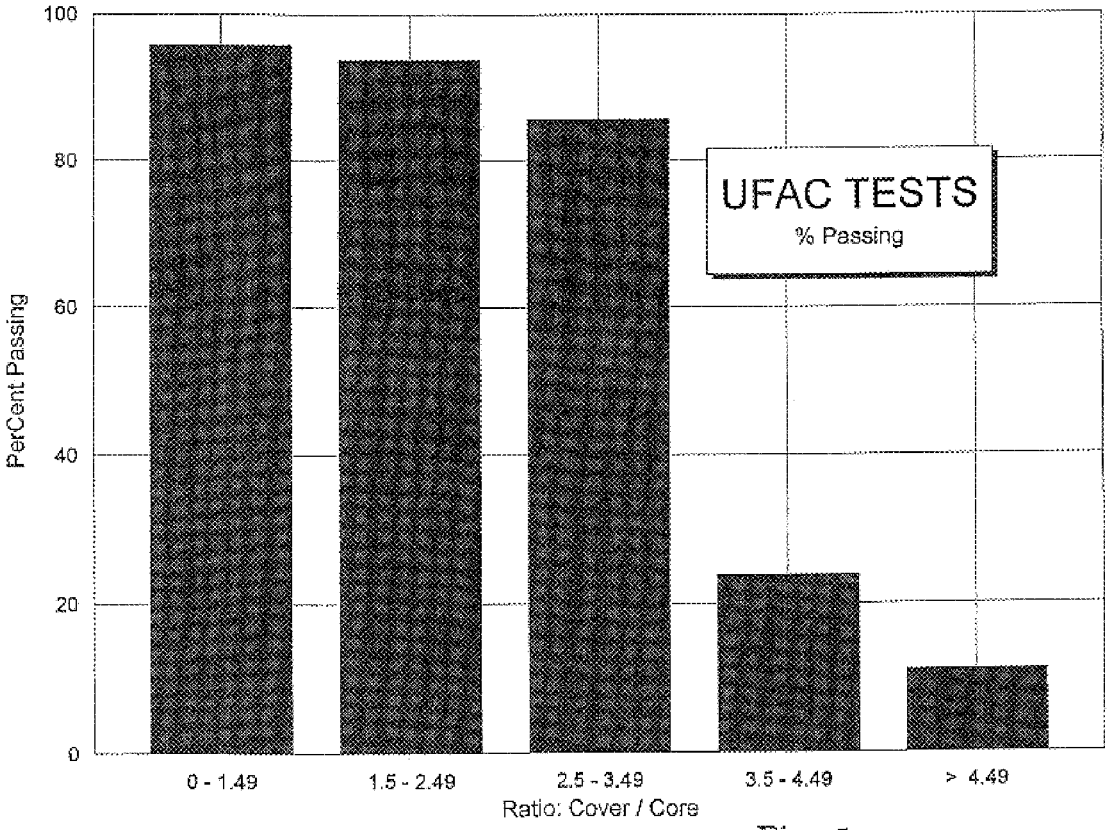
FIG. 5 is a bar graph comparing the cover to core ratio to the percent of samples passing UFAC tests.

FIGS. 4 and 5 are graphs of experimental data showing the importance of having a welt cord cover to core volume ratio of less than about 3.5. In the Upholstered Furniture Action Council (UFAC) test, a lit cigarette, covered by a piece of sheeting material, is placed next to the welt cord, which is placed into a crevice formed by the abutment of vertical and horizontal panels of a small scale test assembly. The cigarette is allowed to burn its entire length or until obvious ignition occurs. Each type of welt cord is tested three times. The charred area caused by the cigarette cannot spread beyond 38 mm for all three welt cord specimens for the sample welt cord to pass the test. In the tests reported in FIGS. 4 and 5, welt cords were tested which were constructed in the manner described above, but with varying cover to core volume ratios. Where the ratio is less than about 3.5, the percentage of samples passing the UFAC test is significantly higher than where the volume ratio exceeds about 3.5. The density of the core, density of the cover, diameter of the finished cord and type of cover (bleached or unbleached wadding) are not critical in developing a passable cord.

Different plastics can be used as the core material. The following table shows that changing the core material has little or no effect on the criticality of the ratio:

| Type of Plastic | Sample with R = 2.67 | Sample with R = 3.51 |
|---|---|---|
| Polypropylene | Pass | Fail |
| Nylon | Pass | Fail |
| High Density Polyethylene | Pass | Fail |
| Med Density Polyethylene | Pass | Fail |
| Low Density Polyethylene | Pass | Fail |
| Foamed LD Polyethylene | Pass | Fail |

Furthermore, the following table shows the preferability of having a ratio of 3.5 or less:

| R Value | # of Tests | Passes | Failures | % Pass |
|---|---|---|---|---|
| R < 3.5 | 61 | 56 | 5 | 91.8% |
| R ≧ 3.5 | 39 | 7 | 32 | 17.9% |
| R < 3.7 | 75 | 60 | 15 | 80.0% |
| R ≧ 3.7 | 25 | 3 | 22 | 12.0% |

Having described the preferred embodiment of the invention, it will be understood to those skilled in the art that modifications may be made without departing from the spirit and broader aspects of the invention.

What is claimed is:

1. A fire retardant welt cord for upholstery comprising:

a core made of a polymeric material and having a circular cross section;

a cover made of cellulose wadding surrounding said core;

wherein the welt cord has a ratio of the volume of cover material to core material of less than about 3.5 and the welt cord is free of any heat conductive member.

2. The fire retardant welt cord of claim 1 wherein said polymeric material is of polyethylene.

3. The fire retardant welt cord of claim 2 wherein said polymeric material is a foam having a density of about 0.3 grams per cubic centimeter.

4. The fire retardant welt cord of claim 3 wherein said cellulose cover is made of crepe sheets.

5. The fire retardant welt cord of claim 4 which includes a jacket around said cellulose cover.

6. The fire retardant welt cord of claim 5 wherein said jacket comprises threads of glass.

7. The fire retardant welt cord of claim 1 wherein said polymeric material is of polyethylene.

8. The fire retardant welt cord of claim 1 wherein said polymeric material is a foam having a density of about 0.3 grams per cubic centimeter.

9. The fire retardant welt cord of claim 1 wherein said cellulose cover is made of crepe sheets.

10. The fire retardant welt cord of claim 1 which includes a jacket around said cellulose cover.

11. The fire retardant welt cord of claim 10 wherein said jacket comprises threads of glass.

12. The fire retardant welt cord of claim 1 wherein said ratio of the volume of cover material to core material is less than about 3.0.

13. The fire retardant welt cord of claim 12 wherein the welt cord is free of any heat conductive member.

14. The fire retardant welt cord of claim 13 wherein said polymeric material is of polyethylene.

15. The fire retardant welt cord of claim 14 wherein said polymeric material is a foam having a density of about 0.3 grams per cubic centimeter.

16. The fire retardant welt cord of claim 15 wherein said cellulose cover is made of crepe sheets.

17. The fire retardant welt cord of claim 16 which includes a jacket around said cellulose cover.

18. The fire retardant welt cord of claim 17 wherein said jacket comprises threads of glass.

19. A fire retardant welt cord for upholstery comprising:

a core made of a flexible polymeric material and extruded in a cylindrical shape;

a cover made of crepe sheets of cellulose wadding and surrounding said core; and a jacket of threads wound or braided around said cover and holding said cover on said core, wherein the welt cord has a ratio of the volume of cover material to core material of less than about 3.5 and the welt cord is free of any heat conductive member.

20. The fire retardant welt cord of claim 19 wherein said polymeric material is a polyethylene foam.

21. The fire retardant welt cord of claim 20 wherein said polyethylene foam has a density of about 0.3 grams per cubic centimeter.

22. The fire retardant welt cord of claim 21 wherein said jacket of threads is of glass.

23. The fire retardant welt cord of claim 19 wherein said jacket of threads is of glass.

24. The fire retardant welt cord of claim 19 wherein said ratio of the volume of cover material to core material is less than about 3.0.

25. The fire retardant welt cord of claim 24 wherein said polymeric material is a polyethylene foam.

26. The fire retardant welt cord of claim 25 wherein said polyethylene foam has a density of about 0.3 grams per cubic centimeter.

27. A fire retardant welt cord for upholstery comprising:

a core made of a polymeric foam material;

a cover made of cellulose wadding and surrounding said core; and a jacket of glass threads around said cover and holding said cover on said core, wherein the welt cord has a ratio of the volume of the core material to the cover material of less than 3.0 and the welt cord is free of any metal heat conductive member.

28. The fire retardant welt cord of claim 27 wherein said polymeric foam material is of polyethylene.

29. The fire retardant welt cord of claim 28 wherein said polyethylene foam has a density of about 0.3 grams per cubic centimeter.

* * * * *